US008042430B2

(12) United States Patent
Campbell

(10) Patent No.: US 8,042,430 B2
(45) Date of Patent: Oct. 25, 2011

(54) ACCELERATOR PEDAL FOR A VEHICLE

(75) Inventor: Andrew Campbell, Scotland (GB)

(73) Assignee: CTS Corporation, Elkhart, IN (US)

( * ) Notice: Subject to any disclaimer, the term of this patent is extended or adjusted under 35 U.S.C. 154(b) by 853 days.

(21) Appl. No.: 11/657,926

(22) Filed: Jan. 24, 2007

(65) Prior Publication Data

US 2007/0137400 A1 Jun. 21, 2007

Related U.S. Application Data

(63) Continuation-in-part of application No. 10/854,837, filed on May 27, 2004, now Pat. No. 7,404,342.

(60) Provisional application No. 60/764,594, filed on Feb. 2, 2006.

(51) Int. Cl.
*G05G 1/30* (2008.04)

(52) U.S. Cl. ..... 74/513

(58) Field of Classification Search ..... 74/512, 74/513, 560

See application file for complete search history.

(56) References Cited

U.S. PATENT DOCUMENTS

| | | | | |
|---|---|---|---|---|
| 3,885,449 | A | 5/1975 | Green | |
| 4,944,269 | A | 7/1990 | Imoehl | |
| 5,013,930 | A | 5/1991 | Spakowski et al. | |
| RE34,302 | E | 7/1993 | Imoehl | |
| 5,408,899 | A * | 4/1995 | Stewart | 74/513 |
| 5,416,295 | A * | 5/1995 | White et al. | 200/86.5 |
| 5,497,677 | A * | 3/1996 | Baumann et al. | 74/513 |
| 5,524,589 | A | 6/1996 | Kikkawa et al. | |
| 5,666,860 | A * | 9/1997 | Baumann et al. | 74/513 |
| 5,697,260 | A | 12/1997 | Rixon et al. | |
| 5,768,946 | A | 6/1998 | Fromer et al. | |
| 5,937,707 | A | 8/1999 | Rixon et al. | |
| 6,003,404 | A | 12/1999 | Hannewald | |
| 6,070,490 | A | 6/2000 | Aschoff et al. | |
| 6,073,610 | A | 6/2000 | Matsumoto et al. | |
| 6,098,971 | A | 8/2000 | Stege | |
| 6,158,299 | A | 12/2000 | Czajkowski | |

(Continued)

FOREIGN PATENT DOCUMENTS

DE 44 07 0005 C1 3/1995

(Continued)

OTHER PUBLICATIONS

U.S. Appl. No. 09/842,940, filed Jan. 2002, Yadehige.

(Continued)

*Primary Examiner* — Vicky A Johnson

(74) *Attorney, Agent, or Firm* — Mark P. Bourgeois; Daniel J. Deneufbourg

(57) ABSTRACT

A pedal assembly that provides a hysteresis in pedal force-response upon actuation is provided. The pedal assembly includes a housing and a pedal arm that has an end. The end has a rotatable drum that defines a braking surface. The pedal arm is rotatably mounted to the housing. A lever extends from the second end. A brake pad is retained by the housing and has a contact surface that is substantially complementary to the braking surface. The brake pad is adapted to be engaged with the braking surface. A bias spring device is situated between the lever and the brake pad for urging the contact surface of the brake pad into frictional engagement with the braking surface of the drum. A sensor is coupled to the pedal arm to sense the position of the pedal arm.

20 Claims, 8 Drawing Sheets

U.S. PATENT DOCUMENTS

| | | | | |
|---|---|---|---|---|
| 6,289,762 | B1 | 9/2001 | Silva | |
| 6,330,838 | B1 | 12/2001 | Kalsi | |
| 6,336,377 | B1 | 1/2002 | Reimann et al. | |
| 6,360,631 | B1 | 3/2002 | Wortmann et al. | |
| 6,418,813 | B1 | 7/2002 | Lewis | |
| 6,426,619 | B1 | 7/2002 | Pfaffenberger et al. | |
| 6,446,526 | B2 | 9/2002 | Reimann et al. | |
| 6,474,191 | B1 | 11/2002 | Campbell | |
| 6,523,433 | B1 | 2/2003 | Staker | |
| 6,553,863 | B1 | 4/2003 | Djordjevic | |
| 6,689,016 | B2 | 2/2004 | Apel | |
| 6,745,642 | B2 | 6/2004 | Kumamoto et al. | |
| 6,809,512 | B2 | 10/2004 | Pfaffenberger et al. | |
| 6,860,170 | B2 * | 3/2005 | DeForest | 74/512 |
| 2002/0152831 | A1 | 10/2002 | Sakamoto et al. | |
| 2004/0237700 | A1 * | 12/2004 | Wurn | 74/514 |
| 2005/0034555 | A1 | 2/2005 | Staker | |
| 2005/0145058 | A1 | 7/2005 | Kohlen et al. | |
| 2008/0276750 | A1 * | 11/2008 | Kim et al. | 74/513 |

FOREIGN PATENT DOCUMENTS

| | | | |
|---|---|---|---|
| DE | 44 26 549 | A1 | 2/1996 |
| DE | 195 04 971 | A1 | 8/1996 |
| DE | 198 11 442 | A1 | 3/1998 |
| DE | 197 01 637 | A1 | 7/1998 |
| DE | 101 35 537 | A1 | 1/2003 |
| DE | 102004047711 | A1 * | 5/2005 |
| EP | 0 670 235 | | 9/1995 |
| EP | 0 748 713 | A2 | 12/1996 |
| EP | 0 926 581 | | 6/1999 |
| EP | 0 899 147 | A1 | 9/1999 |
| EP | 0 974 886 | | 1/2000 |
| EP | 1 033 275 | | 9/2000 |
| EP | 1 154 346 | | 11/2001 |
| FR | 2 138 249 | A | 1/1973 |
| WO | WO 01/14161 | | 3/2001 |
| WO | WO 01/81110 | A1 | 11/2001 |
| WO | WO 2004/107079 | A1 | 12/2004 |

OTHER PUBLICATIONS

U.S. Appl. No. 10/041,411, filed May 2002, Sundaresan et al.

U.S. Appl. No. 10/096,938, filed Aug. 2002, Kumamoto et al.

* cited by examiner

ACCELERATOR PEDAL FOR A VEHICLE

CROSS-REFERENCE TO RELATED AND CO-PENDING APPLICATIONS

This application is a continuation in part of U.S. patent application Ser. No. 10/854,837, filed on May 27, 2004, now U.S. Pat. No. 7,404,342 and titled, "Accelerator Pedal for Motorized Vehicle".

This application also claims the benefit of the filing date of U.S. Provisional Patent Application, Ser. No. 60/764,594, filed on 2 Feb. 2006, the contents of which are explicitly incorporated by reference, as are all references cited therein.

FIELD OF THE INVENTION

This invention relates to a pedal mechanism. In particular, the pedal may be an accelerator pedal in a vehicle.

BACKGROUND OF THE INVENTION

Automobile accelerator pedals have conventionally been linked to engine fuel subsystems by a cable, generally referred to as a Bowden cable. While accelerator pedal designs vary, the typical return spring and cable friction together create a common and accepted tactile response for automobile drivers. For example, friction between the Bowden cable and its protective sheath otherwise reduce the foot pressure required from the driver to hold a given throttle position. Likewise, friction prevents road bumps felt by the driver from immediately affecting throttle position.

Efforts are underway to replace the mechanical cable-driven throttle systems with a more fully electronic, sensor-driven approach. With the fully electronic approach, the position of the accelerator pedal is read with a position sensor and a corresponding position signal is made available for throttle control. A sensor-based approach is especially compatible with electronic control systems in which accelerator pedal position is one of several variables used for engine control.

Although such drive-by-wire configurations are technically practical, drivers generally prefer the feel, i.e., the tactile response, of conventional cable-driven throttle systems. Designers have therefore attempted to address this preference with mechanisms for emulating the tactile response of cable-driven accelerator pedals. For example, U.S. Pat. No. 6,360,631 Wortmann et al. is directed to an accelerator pedal with a plunger subassembly for providing a hysteresis effect.

In this regard, prior art systems are either too costly or inadequately emulate the tactile response of conventional accelerator pedals. Thus, there continues to be a need for a cost-effective, electronic accelerator pedal assembly having the feel of cable-based systems.

SUMMARY

In one embodiment, the present invention provides a pedal assembly. The pedal assembly includes a housing and a pedal arm that has an end. The end has a rotatable drum that defines a braking surface. The pedal arm is rotatably mounted to the housing. A lever extends from the second end. A brake pad is retained by the housing and has a contact surface that is substantially complementary to the braking surface. The brake pad is adapted to be engaged with the braking surface. A bias spring device is situated between the lever and the brake pad for urging the contact surface of the brake pad into frictional engagement with the braking surface of the drum. A sensor is coupled to the pedal arm to sense the position of the pedal arm.

These and other objects, features and advantages will become more apparent in light of the text, drawings and claims.

DETAILED DESCRIPTION

While this invention is susceptible to embodiment in many different forms, this specification and the accompanying drawings disclose several forms as examples of the invention. The invention is not intended to be limited to the embodiments so described, however. The scope of the invention is identified in the appended claims.

Figure 5:
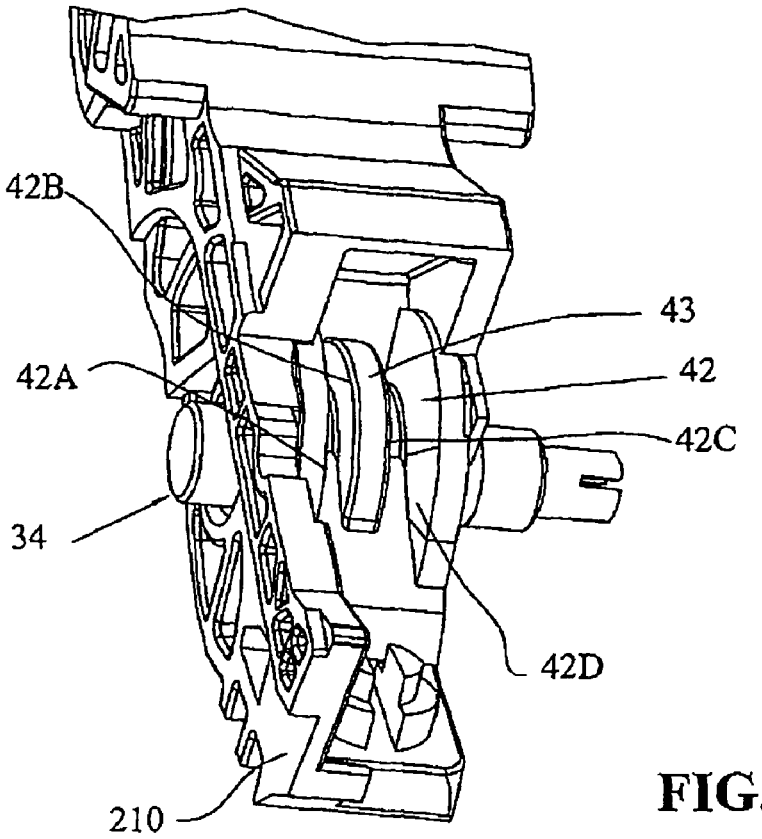
FIG. 5 is an enlarged cross-sectional view of the accelerator pedal assembly of FIG. 1 showing details of the braking surface.
Figure 6:
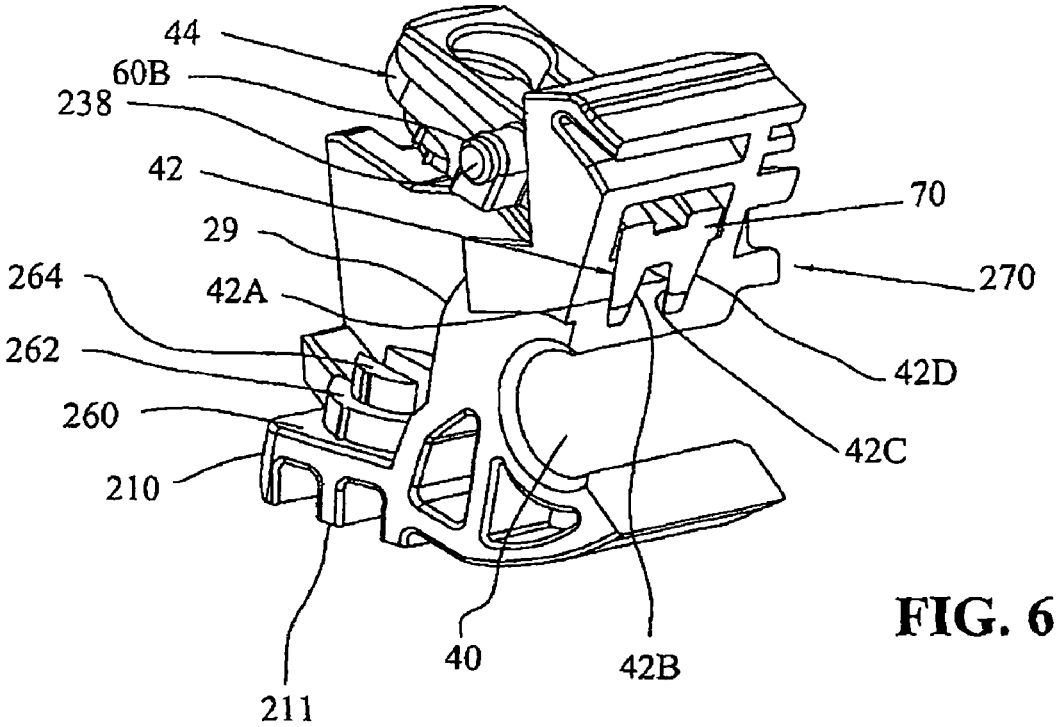
FIG. 6 is an enlarged cross-sectional view of the accelerator pedal assembly of FIG. 1 showing details of the braking surface and brake pad.

Referring to FIGS. 1-4, a non-contacting accelerator pedal assembly 20 according to the present invention includes a housing 32, a pedal arm 22 rotatably mounted to housing 32, a brake pad 44 and a bias spring device 46. The labels "pedal beam" or "pedal lever" also apply to pedal arm 22. Likewise, brake pad 44 may be referred to as a "body" or "braking lever." Pedal arm 22 has ends 22A and 22B. A footpad 27 is located toward end 22A. Pedal arm end 22B has a drum portion 29 that presents a curved, W-shaped braking (or drag) surface 42 (best seen in FIGS. 5 and 6). Drum portion 29 also has a raised center ridge 43. A lever 210 extends from pedal arm end 22B adjacent to drum portion 29.

Housing 32 has a sensor section 82 and a friction mechanism section 37. A sensor 80 is mounted in sensor section 82 and a friction generating mechanism 270 is mounted in friction mechanism section 37.

Pedal arm 22 has a forward side 28 nearer the front of the car and a rearward side 30 nearer the driver and rear of the car.

Footpad 27 may be integral with the pedal lever 22 or articulating and rotating at its connection point to pedal lever 22. Pedal arm 22 has an aperture 40. Braking surface 42 of accelerator arm 22 includes braking surfaces 42A, 42B, 42C and 42D that are define a W-shape. In alternate embodiments, surface 42 can have other shapes.

Pedal arm 22 pivots from housing 32 via an axle connection through drum 29 such that drum 29 and its contact surface 42 rotate as pedal arm 22 is moved. Spring device 46 biases pedal arm 22 towards the idle position. Brake pad 44 is positioned to receive spring device 46 at one end and contact drum 29 at the other end. Brake pad 44 is pivotally mounted to housing 32 such that a contact surface 70 is urged against braking surface 42 as pedal arm 22 is depressed.

Pedal arm 22 is coupled to a sensor assembly 80 in sensor section 82 for creating a signal representative of pedal displacement. Sensor assembly 80 can be a contacting variable resistance position sensor. Other sensors could also be used such as optical, mechanical, electrical, magnetic and chemical means.

In an embodiment as illustrated, housing 32 also serves as a base for the mounted end 22B of pedal arm 22 and for sensor 80. Proximal end 22B of pedal arm 22 is pivotally secured to housing 32 with an axle 34. More specifically, drum portion 29 of pedal arm 22 includes an opening 40 for receiving axle 34, while housing 32 has a friction generating cavity or section 37 with corresponding openings 39A and 39B also for receiving axle 34. Axle 34 may be press fit into opening 40. Axle 34 is narrowed at its ends where it is collared and supported by a bearing journals 19 that are mounted in openings 39A and 39B. A cover 220 is mounted to housing 32 and covers one end of axle 34 and bearing 19.

Figure 8:
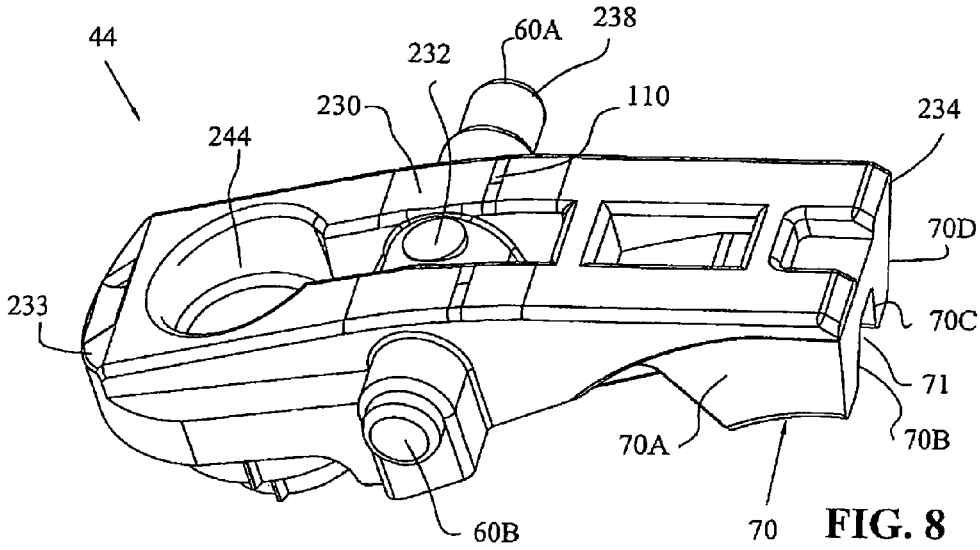
FIG. 8 is an isometric view of the break pad of the accelerator pedal assembly.
Figure 9:
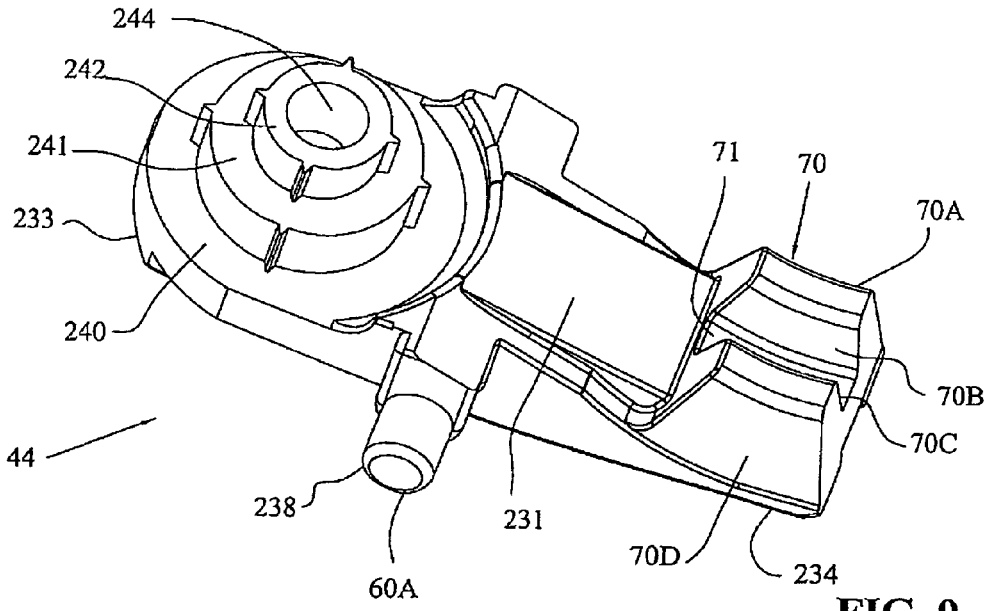
FIG. 9 is another isometric view of the break pad of the accelerator pedal assembly.
Figure 11:
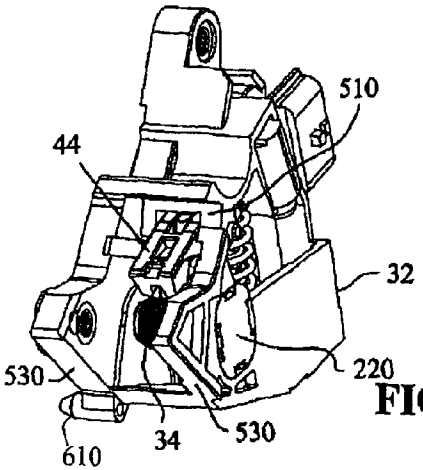
FIG. 11 is a partial cut-away view of FIG. 1 showing the brake pad mounted in the housing.
Figure 10:
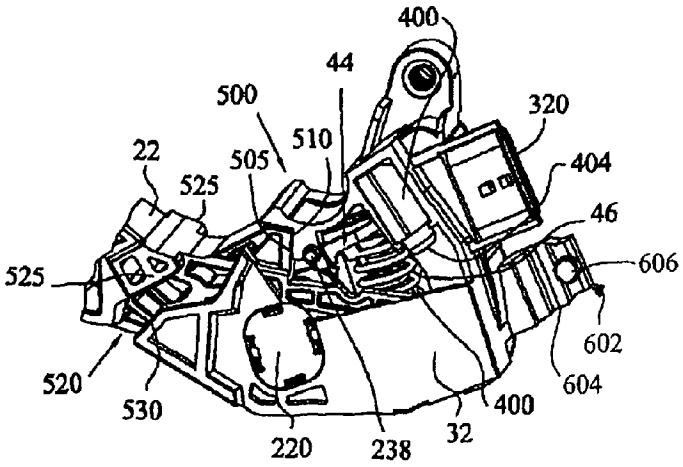
FIG. 10 is a partial cut-away view of FIG. 1 showing the brake pad mounted in the housing.
Figure 13:
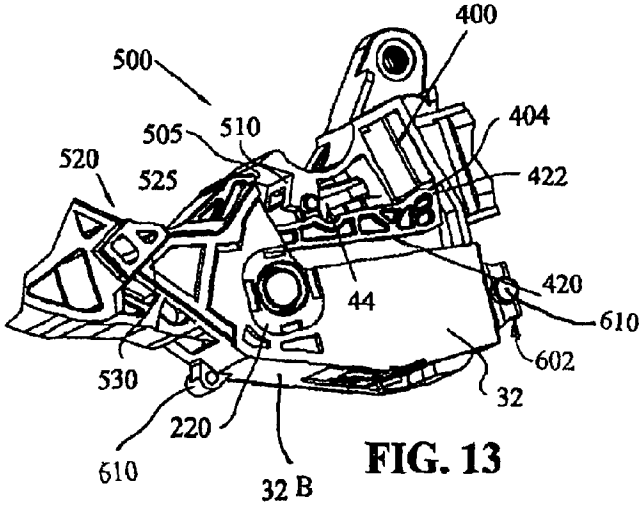
FIG. 13 is a partial cut-away view of FIG. 1 showing the kickdown lever.
Figure 12:
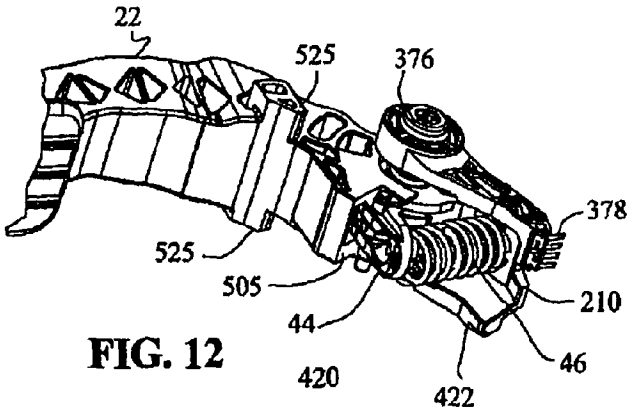
FIG. 12 is an isometric view of the pedal arm, brake pad and spring.

Turning now to FIGS. 8 and 9, in addition to contact surface 70, the other features of brake pad 44 include a top 230, a bottom 231 a button 232, a ridge 110 and ends 233 and 234.

Contact surface 70 is W-shaped and is located at end 234. Contact surface 70 includes contact surfaces 70A, 70B, 70C and 70D that define a W-shape. In alternate embodiments, contact surface 70 can have other shapes. Contact surfaces 70A-D mate with braking surfaces 42A-D to form a friction generating mechanism 270.

Brake pad 44 also has opposed trunnions 60A and 60B (also called outriggers or flanges) to define a primary pivot axis 238 positioned between spring device 46 and contact surface 70. Contact surface 70 of brake pad 44 is situated on one side of this pivot axis and a donut-shaped socket 104 for receiving one end of bias spring 46 is provided on the other side.

Brake pad 44 has stepped flanges 240, 241 and 242 located toward end 233. An aperture 233 passes through flange 242. Bias spring device 46 includes bias springs 46A and 46B. Spring 46A is larger in diameter than spring 46B. Springs 46A and 46B are co-axial with spring 46B being located inside spring 46A. Springs 46A and 46B provide redundancy in case one of the springs fail, another is able to operate. One end of spring 46A goes over flange 241 and rests on flange 240. One end of spring 46B goes over flange 242 and rests on flange 241.

Contact surface 70 is substantially complementary to braking surface 42. In one embodiment, contact surface 70 is curved and w-shaped with a substantially constant radius of curvature. In alternate embodiments, braking surface has a varying radius of curvature and other shapes. The frictional engagement between contact surface 70 and braking surface 42 may tend to wear either surface. The shape of contact surface 42 may be adapted to reduce or accommodate wear.

Referring now to FIGS. 1-7, housing 32 is provided with spaced slots 66 for slidably receiving the trunnions 60A and 60B. Trunnions 60A and 60B are substantially cylindrical in shape. Brake pad 44 pivots on trunnions 60A and 60B in slots 66 and 67.

With brake pad 44 mounted in trunnions 60A and 60B, ridge 110 may contact a portion 248 of housing 32 in cavity 37. Ridge 110 and portion 248 may form a secondary pivot axis 250 on which brake pad 44 may pivot or rock.

Pedal arm 22 includes a lever 210 that extends from pedal arm end 22B. Lever 210 includes a bottom 211, a flat base portion 260, a rounded flange 262 and another rounded flange 264. One end of spring 46A rests on base portion 260 and one end of spring 46B rests on flange 262. Therefore, bias spring device 46 is situated between lever 210 and brake pad 44. Spring device 46 includes two, redundant coil springs 46A and 46B in a concentric orientation, one spring nestled within the other. This redundancy is provided for improved reliability, allowing one spring to fail or flag without disrupting the biasing function. It is useful to have redundant springs and for each spring to be capable—on its own—of returning the pedal lever 22 to its idle position.

As pedal arm 22 is moved in a first direction 72 (accelerate) or the other direction 74 (decelerate), the force $F_S$ within compression spring 46 increases or decreases, respectively. Brake pad 44 is moveable in response to the spring force $F_S$.

As pedal arm 22 moves towards the idle/decelerate position (direction 74), the resulting drag between braking surface 42 and contact surface 70 urges brake pad 44 towards a position in which trunnions 60A and 60B move slightly outward in slots 66 and 67. This change in position of brake pad 44 may not be visibly detectable. As pedal arm 22 is depressed (direction 72), the drag between braking surface 42 and contact surface 70 draws brake pad 44 further into cavity portion 37 and causes trunnions 60A and 60B to move slightly inward in slots 66 and 67. The sliding motion of brake pad 44 is gradual and can be described as a "wedging" effect that either increases or decreases the force urging contact surface 70 into braking surface 42. This directionally dependent hysteresis is desirable in that it approximates the feel of a conventional mechanically-linked accelerator pedal.

Figure 7:
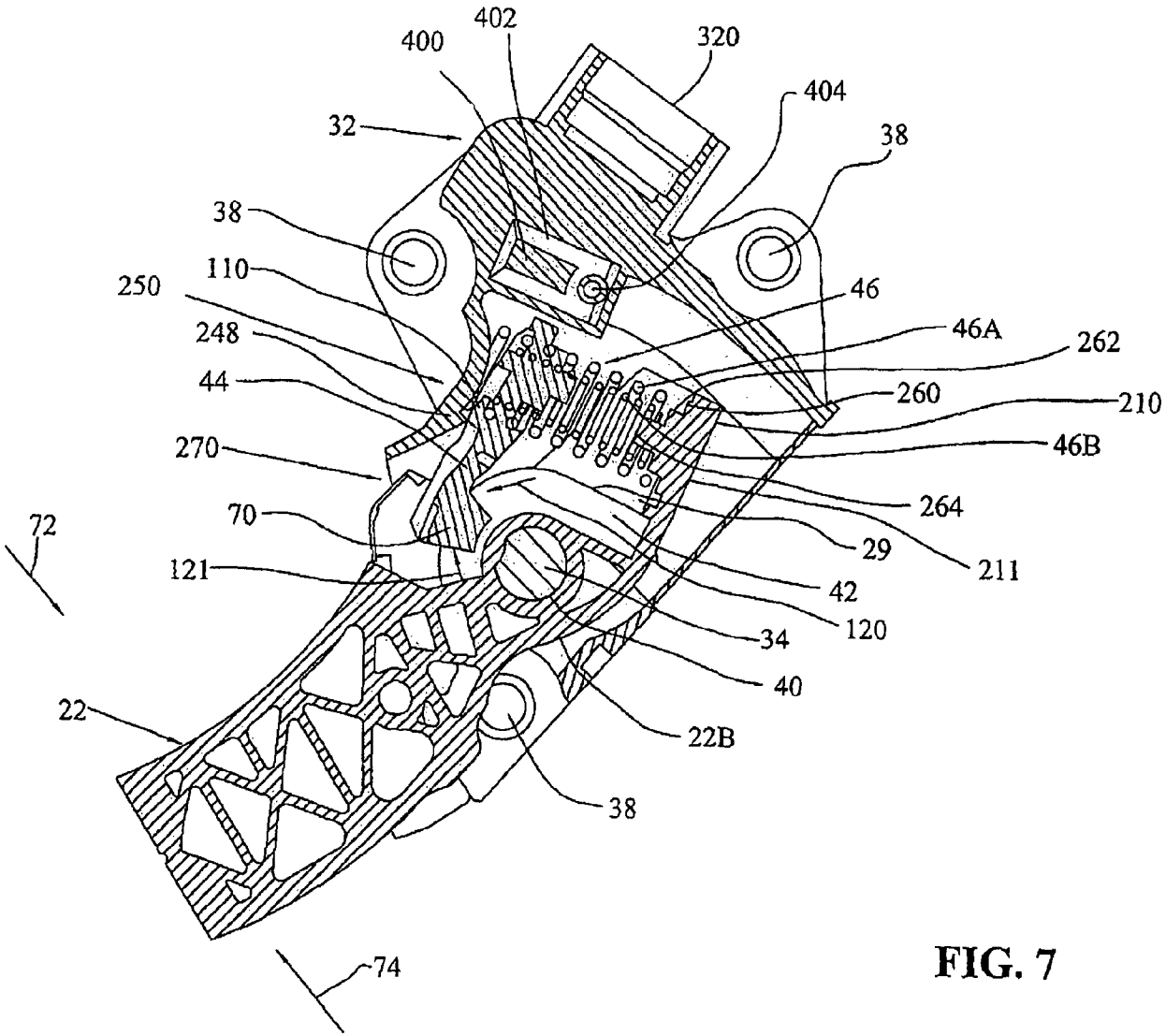
FIG. 7 is a cross-sectional view of the accelerator pedal assembly of FIG. 1.

When pedal force on arm 22 is increased, brake pad 44 is urged inwardly on slots 66 and 67 by the frictional force created on contact surface 70 as braking surface 42 rotates forward (direction 120 in FIG. 7). This urging forward of brake pad 44 likewise urges trunnions 60A and 60B into slots 66 and 67, such that the normal, contact force of contact surface 70 into braking surface 42 is relatively reduced.

It is noted that the W-shape of braking surface 42 and contact surface 70 provides a larger area to generate increased friction over than just a simple straight surface.

When pedal force on arm 22 is reduced, the opposite effect is present: the frictional, drag force between 44 and braking surface 42 urges brake pad 44 outward from slots 60A and 60B (direction 121 in FIG. 7). This urging backward of brake pad 44 urges trunnions 60A and 60B outward from slots 60A and 60B such that the normal-direction, contact force between braking surface 42 and contact surface 70 is relatively increased. The relatively higher contact force present as the pedal force on arm 22 decreases allows a driver to hold a given throttle position with less pedal force than is required to move the pedal arm for acceleration.

Also for improved reliability, brake pad 44 is provided with redundant pivoting (or rocking) structures. In addition to the primary pivot axis 238 defined by trunnions 60A and 60B, brake pad 44 defines a ridge 110, which forms a secondary pivot axis 250.

When assembled, ridge 110 is juxtaposed to portion 248 and may form a secondary pivot axis 250 on which brake pad 44 may pivot or rock. The secondary pivot axis provided by ridge 110 and portion 248 is a feature of accelerator pedals according to the present invention to allow for failure of the structural elements that provide the primary pivot axis, namely trunnions 60A and 60B and slots 66 and 67. Should the structure of these features be compromised, the pivoting action of brake pad 44 can occur at ridge 110.

With reference to FIGS. 10-13, pedal arm 22 has predetermined rotational limits in the form of an idle, return position stop 500 and a depressed, open-throttle position stop 520. Open throttle position stop 520 comprises pedal arm posts 525 that extend out from each side of pedal arm 22 and stop walls 530 on housing 32. When pedal arm 22 is fully depressed, pedal arm posts 525 come to rest against stop walls 530, thereby limiting forward movement of pedal arm 22. Stops 500 and 520 may be elastomeric or rigid.

Idle position stop 500 comprises pedal arm wall 505 and housing wall 510. When pedal arm 22 is released, pedal arm wall 505 comes to rest against housing wall 510 and can not move any further in direction 74 (FIG. 7).

Figures 1, 2:
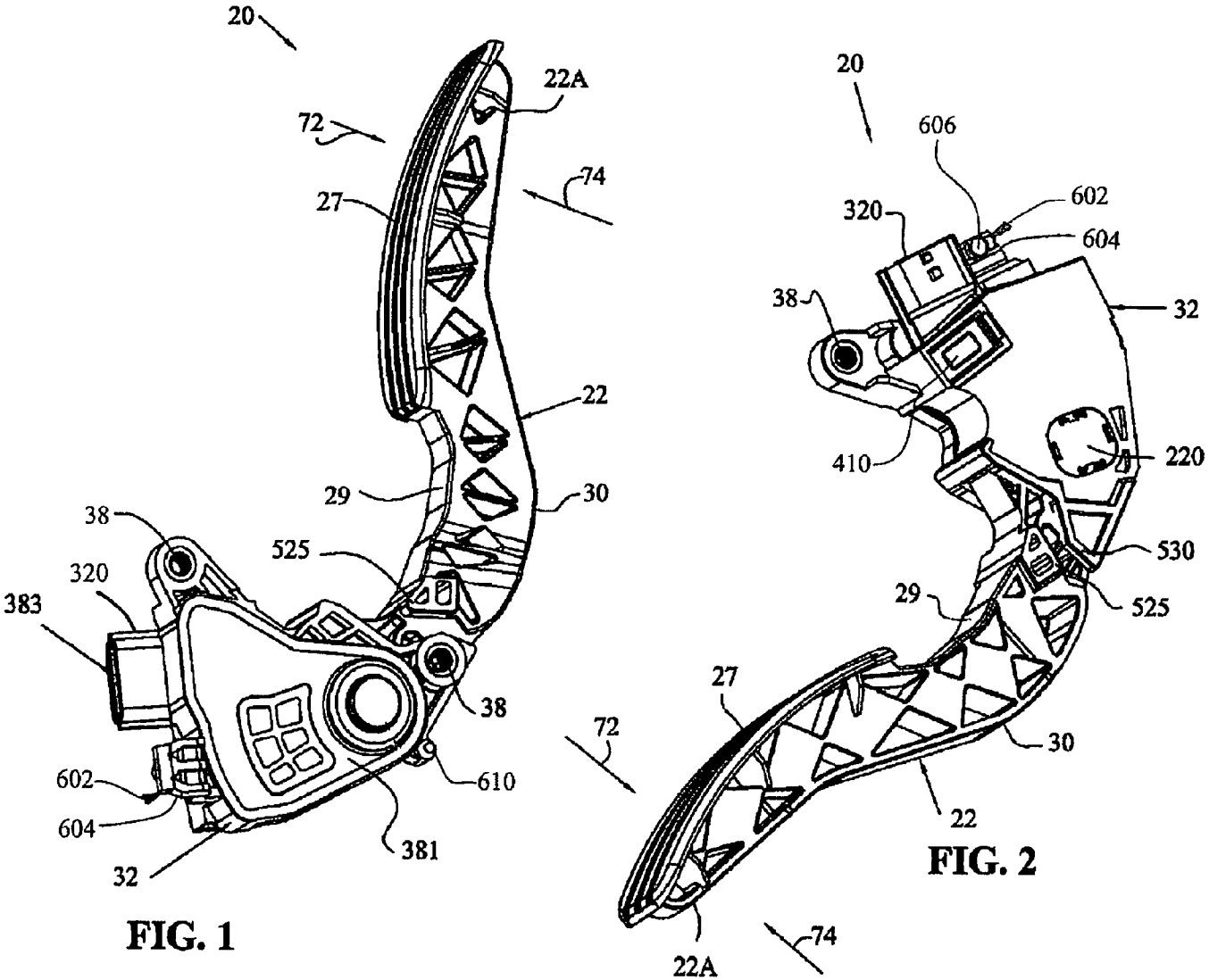
FIG. 1 is an assembled isometric view of the accelerator pedal assembly of the present invention.
FIG. 2 is another assembled isometric view of the accelerator pedal assembly of the present invention.
Figure 3:
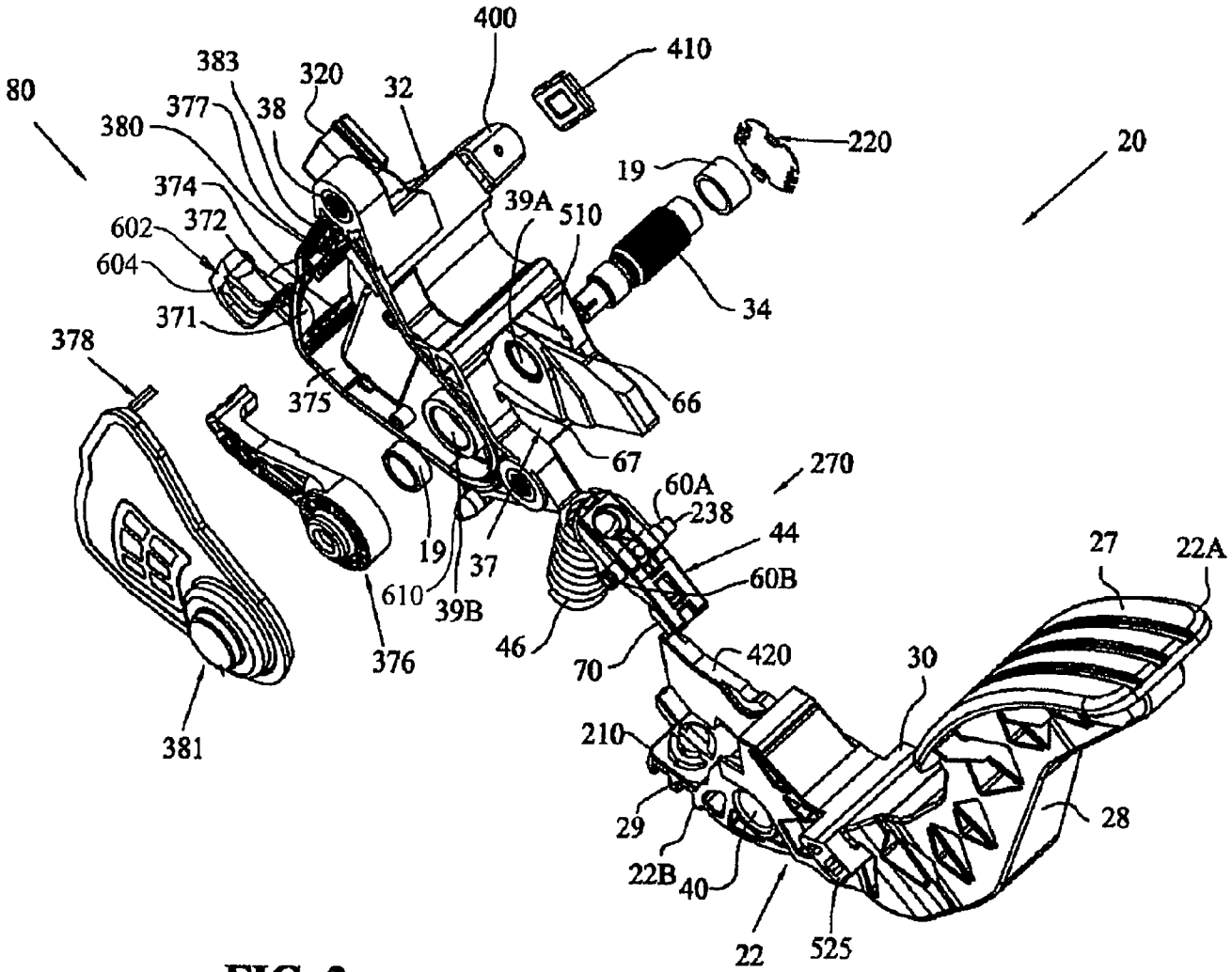
FIG. 3 is an exploded isometric view of the accelerator pedal assembly of FIG. 1.
Figure 4:
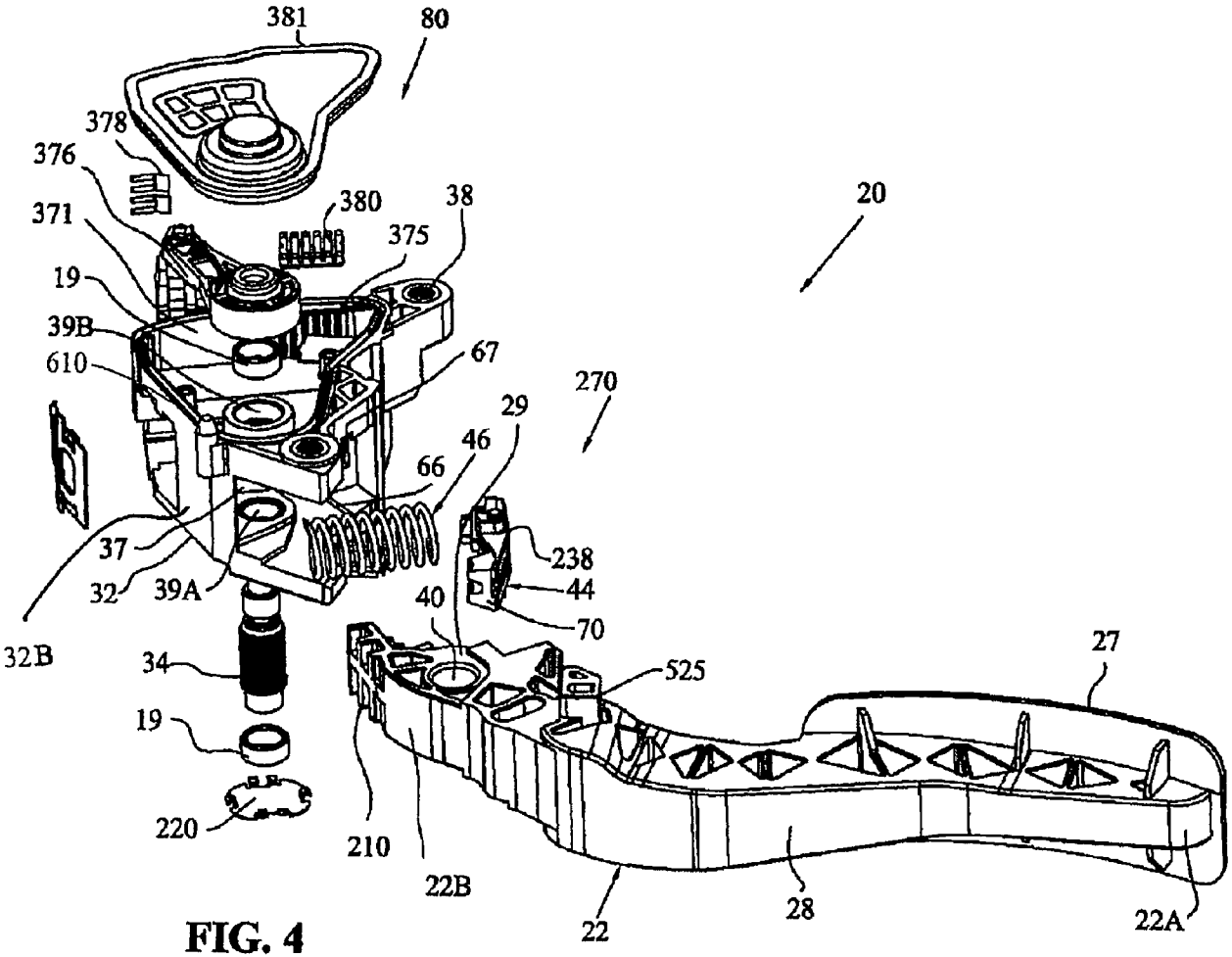
FIG. 4 is another exploded isometric view of the accelerator pedal assembly of FIG. 1.

Turning back to FIGS. 1-7, housing 32 is securable to a vehicle wall via fasteners through mounting holes 38. Pedal assemblies according to the present invention are suitable for both firewall mounting or pedal rack mounting by means of an adjustable or non-adjustable position pedal box rack via a bracket or clip 602 (FIGS. 1 and 2) and a pin 610 (FIGS. 1, 3, 4, 11, and 13). Clip 602 projects outwardly from the side or wall 32A of housing 32. In the embodiment as shown in FIG. 3, clip 602 is in the form of an L-shaped arm or hook 604 which includes a first portion 605 which protrudes outwardly from the wall 32A of housing 32, an elbow 607 at the end of the first portion 605, and a second portion 609 projecting from the elbow 607 in a relationship generally normal to the first portion 605 and spaced from the side or wall 32A of housing 32 and includes a round pin 606 (FIG. 2) which protrudes outwardly from a distal end of the exterior surface of the second portion 609 of the arm 604 and faces the connector shroud 320. The pin 610 projects outwardly from a side 32B of housing 32 and extends in the direction of cover 381.

Housing 32 also has a sensor section or cavity 82. Sensor assembly 80 can be mounted in sensor section 82. Sensor assembly 80 can include a Kapton flexible film 371 that has resistor tracks 372 and conductor tracks 374. Film 371 is located in sensor cavity 82 and rests against wall 375. One end of film 371 is located in slot 377. Terminals 383 are insert molded into housing 32. The terminals would extend into connector shroud 320 and can be connected with a wire harness. A metal pressure wedge 380 is pressure fit into slot 377 to make electrical connections between conductor tracks 374 and terminals 383. A rotor 376 is pressure fit over shaft 34. Rotor 376 has contactors or wipers 378 attached to one end of the rotor. A sensor cover 381 is ultrasonically welded to housing 32 to seal sensor cavity 82. In operation rotor 376 moves as shaft 34 does. Shaft 34 is connected to pedal arm 22. Movement of pedal arm 22 causes rotor 376 and contactors 378 to move along resistor tracks 372 and conductor tracks 374. As the contactors 378 move, a voltage applied to the terminals will change magnitude. This is called an electrical output signal and is indicative of the position of pedal arm 22. Additional details on the operation and construction of sensor assembly 80 are detailed in U.S. Pat. Nos. 5,416,295 and 6,474,191, the contents of which are specifically herein incorporated by reference in their entirety.

When a vehicle operator presses on pedal arm 22, shaft 326 rotates. As shaft 326 rotates, rotor 376 turns which causes the wipers 378 to move along the resistor tracks 372 and conductor tracks 374 which causes the electrical output signal to change as a function of the pedal position.

A wire harness (not shown) would be mounted to connector shroud 320 and connect with terminals 383. The wire harness typically connects with an engine control computer. The engine control computer controls an electric motor attached to a throttle plate mounted on the intake of the engine. In this manner, the pedal assembly is able to control the throttle setting on the engine electronically or through a wire. Systems of this type are called drive by wire systems.

Housing 32 can further have a kickdown clip opening or cavity 402 located on the side of housing 32. A kickdown clip 400 can be mounted inside of and be retained by cavity 402. Kickdown clip 400 can include a projecting button 404. Pedal arm 22 may also include a kickdown lever 422 that has a flat wall portion 422. Kickdown lever 422 extends from lever 210 along one side of spring 46.

Additional details on the operation and construction of kickdown clip 400 are detailed in U.S. Pat. No. 6,418,813, entitled, "Kickdown Mechanism for a Pedal",the contents of which are specifically herein incorporated by reference in their entirety.

When the pedal arm 22 is near a point of maximum depression, flat wall portion 422 presses on and engages button 404 of kickdown clip 400. Extra force is then required to be applied to pedal arm 22 to cause button 404 to move inwardly into kickdown clip 400. The kickdown clip provides a tactile feedback to the pedal operator that the pedal is at a maximum point of depression. The maximum point of pedal depression can correspond to a wide open engine throttle position or can be used to indicate a downshift point for an automatic transmission.

When a pedal operator lifts his foot from footpad 27, the loaded bias spring device 46 causes pedal arm 22 to rotate about axle 34 back to the original starting position. This position corresponds to an idle engine throttle position.

When footpad 27 is depressed, an increasing normal force $F_N$ is exerted by the contact surface 70 against braking surface 42. A friction force $F_f$ between the surface 70 and surface 42 is defined by the coefficient of dynamic friction multiplied by normal force $F_N$. As the normal force $F_N$ increases with increasing applied force $F_a$ at footpad 27, the friction force $F_f$ accordingly increases. The driver feels this increase in his/her foot at footpad 27. Friction force Ff runs in one of two directions along face 70 depending on whether the pedal lever is pushed forward 72 or rearward 74. The friction force $F_f$ opposes the applied force $F_a$ as the pedal is being depressed and subtracts from the spring force $F_S$ as the pedal is being returned toward its idle position.

The pedal assembly 20 of the present invention can have a directionally dependent actuation-force hysteresis. Initially are larger amount of force may be required to start movement of pedal arm 22. A smaller amount of force may then be needed to keep moving pedal arm 22.

Pedal assembly 20 may further have a no-movement zone that allows the driver to reduce foot pedal force while still holding the same accelerator pedal position.

Figure 14:
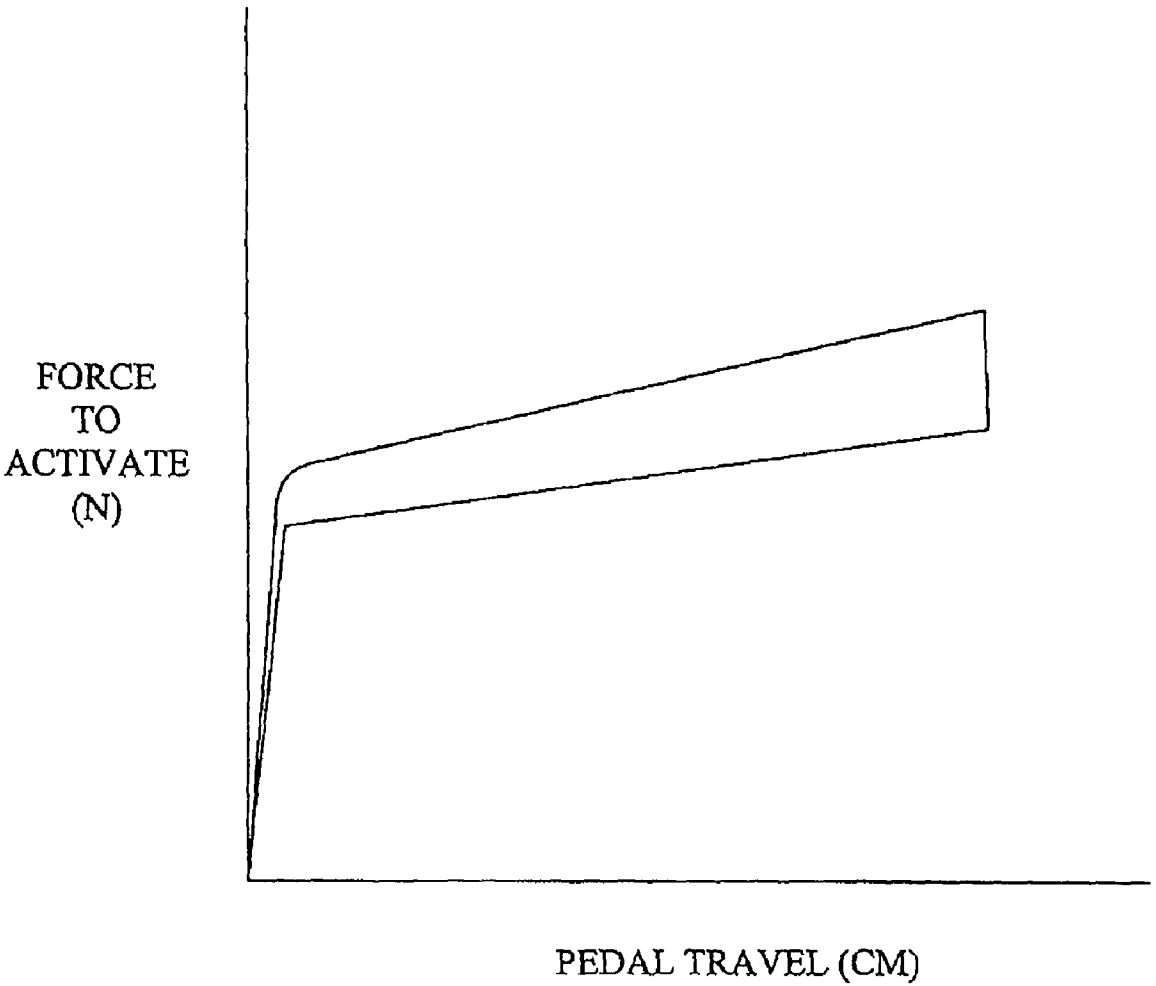
FIG. 14 is a force diagram demonstrating the tactile response of the accelerator pedal according to the present invention.

FIG. 14 shows a graph of force versus pedal arm travel demonstrating the directionally dependent actuation-force hysteresis provided by accelerator pedal assembly 20 of the present invention. In an embodiment, pedal force can be reduced 40 to 50 percent before pedal arm 22 begins to move towards an idle position.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

What is claimed is:

1. A pedal assembly comprising:

a housing defining a front opening, a back wall, opposed side walls defining respective slots, and a top wall;

a pedal arm having a first end and a second end, the first end extending through the front opening and having a rotatable drum in the housing that defines a braking surface, the pedal arm being rotatably mounted to the housing;

a lever extending in the housing from the drum of the pedal arm in the direction of the back wall of the housing;

a brake pad located in the housing between the top wall of the housing and the drum of the pedal arm and having a contact surface that is substantially complementary to the braking surface, the brake pad being adapted to be engaged with the braking surface, the brake pad including opposed trunnions supported in the respective slots defined in the opposed side walls of the housing and defining a primary pivot axis for the brake pad; and a first bias spring device operably situated in the housing between and in a relationship generally normal to the lever and the brake pad, the bias spring device having one end abutting against the lever and an opposite end abutting against the brake pad for urging the contact surface of the brake pad into frictional engagement with the braking surface of the drum, the bias spring device being located in the housing between the drum of the pedal arm and the back wall of the housing.

2. The pedal assembly in accordance with claim 1 wherein one of the contact surface of the brake pad or the braking surface of the drum defines a groove and the other of the braking surface on the drum or the contact surface of the brake pad includes a ridge extending into the groove in the contact surface of the brake pad or the braking surface of the drum.

3. The pedal assembly in accordance with claim 1 wherein a sensor is connected to the pedal arm.

4. The pedal assembly in accordance with claim 3 wherein the housing has a first section and a second section.

5. The pedal assembly in accordance with claim 4 wherein the sensor is mounted in the first section and the brake pad is mounted in the second section.

6. The pedal assembly in accordance with claim 1 wherein the brake pad has at least one flange, the end of the bias spring device abutted against the brake pad and extending over the flange.

7. The pedal assembly in accordance with claim 1 further comprising a second bias spring device nestled in the first bias spring device and wherein the brake pad has a first and second flange, the end of the first bias spring device extending over the first flange and an end of the second bias spring device extending over the second flange.

8. The pedal assembly in accordance with claim 1 wherein a position sensor is secured to the housing and responsive to the movement of the pedal arm for providing an electrical signal representative of pedal displacement.

9. A pedal assembly comprising:

a housing having a first section including a back wall and a second section;

a pedal arm having a first end that can be moved and a second end that is rotatably fixed to the housing in the first section, the second end including a lever;

a friction generating device located in the first section of the housing for changing the amount of force required to move the first end;

a sensor mounted in the second section and coupled to the second end of the pedal arm, the sensor being adapted to sense the position of the pedal arm and provide an electrical signal that is indicative of the position of the pedal arm; and a kickdown clip located in the first section of the housing between the friction generating device and the back wall of the housing, the lever on the second end of the pedal arm being adapted to engage against the kickdown clip.

10. The pedal assembly in accordance with claim 9 wherein the sensor comprises:

a rotor coupled to the pedal arm;

a contactor mounted to the rotor;

a resistor supported by the housing and juxtaposed to the contactor.

11. The pedal assembly in accordance with claim 10 wherein the resistor is mounted to a film.

12. The pedal assembly in accordance with claim 10 wherein the rotor is coupled to the pedal arm through a shaft.

13. A pedal assembly comprising:

a housing having a first section including a back wall and a second section;

a pedal arm having a first end that can be moved and a second end that is rotatably fixed to the housing in the first section;

a rotatable drum affixed to the second end of the pedal arm and defining a braking surface;

a lever coupled to and extending from the second end of the pedal arm;

a brake pad retained by the housing and having a contact surface that is juxtaposed to the braking surface, the brake pad adapted to be engaged with the braking surface;

a friction generating device located in the first section of the housing for changing the amount of force required to move the first end;

a sensor mounted in the second section and coupled to the second end of the pedal arm, the sensor being adapted to sense the position of the pedal arm and provide an electrical signal that is indicative of the position of the pedal arm;

a kickdown clip located in the first section of the housing between the friction generating device and the back wall of the housing; and a bias spring device located in the first section of the housing and having one end abutted against the lever and an opposed end abutted against the brake pad for urging the contact surface of the brake pad into frictional engagement with the braking surface of the drum, the bias spring device being located in the first section of the housing between the drum and the kickdown clip.

14. The pedal assembly in accordance with claim 13 wherein the brake pad is provided with opposed trunnions that define a primary pivot axis.

15. The pedal assembly in accordance with claim 14 wherein the brake pad is provided with at least one spring post.

16. The pedal assembly in accordance with claim 14 wherein the housing has a pair of opposed slots defined in the opposed side walls respectively, the trunnions being supported in the slots respectively.

17. A pedal assembly comprising a housing including opposed side walls provided with spaced slots respectively;

a pedal arm rotatably coupled to the housing;

a rotatable drum integral with the pedal arm and extending into the housing, the drum defining a braking surface;

a brake pad located in the housing and defining a contact surface juxtaposed to the braking surface and mounted for frictional engagement with the braking surface, the brake pad having opposed trunnions that define a pivot axis, the trunnions being supported in the spaced slots in the opposed side walls of the housing; and a bias spring device operably mounted in the housing between the drum and the brake pad for urging the contact surface of the brake pad in increasing frictional engagement with the braking surface of the drum as the pedal arm is depressed and for returning the pedal lever to a rest position when the pedal arm is not depressed.

18. The pedal assembly in accordance with claim 17 wherein a lever extends from the drum, the bias spring device having one end abutted against the lever and an opposed end abutted against the brake pad.

19. The pedal assembly in accordance with claim 17 wherein a sensor is coupled to the pedal arm.

20. The pedal assembly in accordance with claim 17 wherein the braking surface and the contact surface are substantially w-shaped.

* * * * *